United States Patent [19]

McMullan et al.

[11] 4,358,668

[45] * Nov. 9, 1982

[54] HEATER WITH REINFORCING STRATE

[75] Inventors: James P. McMullan, 12300 Monarch, Garden Grove, Calif. 92641; Albert Stevens, Orange, Calif.

[73] Assignee: James P. McMullan, Garden Grove, Calif.

[ * ] Notice: The portion of the term of this patent subsequent to May 26, 1998, has been disclaimed.

[21] Appl. No.: 253,354

[22] Filed: Apr. 13, 1981

Related U.S. Application Data

[63] Continuation-in-part of Ser. No. 86,400, Oct. 19, 1979, Pat. No. 4,270,040.

[51] Int. Cl.[3] ..... H05B 3/34

[52] U.S. Cl. ..... 219/528; 219/212; 219/510; 219/530; 219/544; 219/549; 219/541

[58] Field of Search ..... 219/211, 212, 345, 494, 219/505, 510, 512, 516, 527, 528, 529, 530, 540, 535, 541, 544, 548, 549; 338/210, 212, 214

[56] References Cited

U.S. PATENT DOCUMENTS

| | | | |
|---|---|---|---|
| 2,018,512 | 10/1935 | DeLancy et al. | 219/528 |
| 2,114,396 | 4/1938 | McFarlan | 219/528 |
| 2,961,522 | 11/1960 | Hammer | 219/541 |
| 3,657,517 | 4/1972 | Hoyt | 219/535 |
| 3,790,753 | 2/1974 | Miller | 219/528 |
| 3,904,850 | 9/1975 | Johnson | 219/528 |
| 4,139,763 | 2/1979 | McMullan et al. | 219/528 |
| 4,149,066 | 4/1979 | Niibe | 219/505 |
| 4,220,848 | 9/1980 | McMullan et al. | 219/528 |
| 4,270,040 | 5/1981 | McMullan et al. | 219/528 |

*Primary Examiner*—Volodymyr Y. Mayewksy

[57] ABSTRACT

A flat, normally horizontal electric resistance blanket heater comprising a thin, fragile elongate resistance element on one surface of and carried by a thin, flexible sheet of dielectric material, a thin, flat resilient and flexible reinforcing strate of dimensionally stable material retained adjacent the other surface of the film to permit flexure of the heater and without dimensional distortion of the film and element and a flexible envelope encapsulating the sheet element and strate.

The heater also includes temperature responsive switching means responsive to the temperature of heated portions of the heater and in temperature insulated relationship from a portion of the heater where the element connects with power supply lines and which creates a portion in the heater of increased mass and heat storing capacity.

20 Claims, 10 Drawing Figures

-17-
-17-

HEATER WITH REINFORCING STRATE

This is a continuation-in-part of our application Ser. No. 086,400, filed Oct. 19, 1979, entitled "Improved Heater With Reinforcing Strate" now U.S. Pat. No. 4,270,040.

This invention has to do with blanket-type resistance heaters and is particularly concerned with an improved blanket-type heater with novel reinforcing and temperature control means.

In the art of blanket-type heaters, there is great need for thin, flexible, inexpensive heaters which are such that they can be subjected to intermittent flexure by the directing of external forces therethrough.

More particularly, there is great need for a flexible heater structure of the character referred to which can be advantageously arranged and used in combination with flexible, yielding and/or movable structures. For example, there is a need for flexible blanket-type heaters to heat water bed mattresses which are supported by resilient foam plastic pads and wherein the heaters are arranged between the bottoms of the mattresses and the tops of the underlying supportive pads. In such a combination and relationship of parts, the flat, flexible blanket-type heaters, between the mattresses and the pads, are subject to being flexed and bent when the weight of persons atop the mattresses is exerted downwardly in the area or zone in which the heaters occurs to cause "bottoming out" of the mattresses, yielding compaction of the pads and flexing of the heaters therebetween.

Flexure of a flat, horizontal blanket-type heater in the manner set forth above results in the distribution of resolved compressive and/or tensile forces throughout the plane of the blanket heater structure which tend to stretch, tear, break, wrinkle and otherwise adversely affect the resistance element within the heater structure, which element is commonly in the form of an elongate, thin or fine wire or ribbon of electrically resistive metal arranged in a zig-zag or serpentine manner within the heater structure.

In the prior art, in some instances where blanket-type resistance heaters are to be subjected to flexure in the manner noted above, the elements of the heater have been established of heavy jacketed reinforced wire-type resistance elements hand-laid and loosely arranged within the other related parts of the heater structures so that the elements are capable of moving relative to the said other parts and can withstand anticipated tensioning when the heaters are flexed. Such a heater structure is disclosed in our U.S. Pat. No. 4,220,848, entitled "WATER BED HEATER", issued Sept. 2, 1980.

While the heater structures such as disclosed in our above patent are desirable and effective, they require the utilization of heavy and costly materials, require considerable hand work in the course of their manufacture, are heavy and bulky and are necessarily so costly that their practical use is limited to those situations where their cost is not a major factor or cannot be avoided.

In the art of flexible blanket-type heaters, forms of resistance elements have been developed which lend themselves to mass production at low cost and which are such that they lend themselves to being incorporated in related heater structures in extremely efficient and economical manners. These heater structures are distinguishable from other heaters by the provision and/or inclusion of elongate metal resistance elements which are so thin, fine and delicate or fragile that they require special means to support and carry them. The support means most commonly provided are thin, flexible carrier sheets of dielectric plastic material on which the elements are fixed in predetermined position.

One embodiment of the above noted new form of resistance element comprises a flat, thin and flexible sheet of thermo-set plastic, such as Mylar, on which a thin foil of aluminum is cemented and wherein portions of the foil are removed by a suitable masking and etching process; whereby the resulting resistance element is an elongate, thin and delicate foil ribbon (substantially incapable of freely supporting itself) supported on the surface of and carried by the plastic sheet. This new form of plastic film supported metal foil ribbon resistance element is engaged within an insulative and protective envelope of flexible plastic sheeting.

The above noted form of heater construction is disclosed in U.S. Pat. No. 4,139,763 and has proven to be extremely effective and dependable in operation and is extremely economical to manufacture. The noted patented heater structure and other equivalent heater structures are mass-produced and are commonly used in those situations where the heaters are static when in use, that is, where they are not subjected to being bent, flexed and otherwise physically worked.

It has been determined that when the noted patented heater and other heaters of like or similar nature are subjected to repeated tensioning and working when in use, the thin and fragile elements are readily stretched, torn, broken or otherwise adversely affected to the end that the heaters are rendered inoperative.

OBJECTS AND FEATURES OF THE INVENTION

An object of the present invention is to provide a flexible blanket-type heater including a thin, fine and fragile metal heating element on a thin, flexible carrier sheet and a thin, flat, dimensionally stable reinforcing plate or strate related to the carrier sheet whereby the sheet and the element are not subject to tensile, compressive and bending forces likely to damage or adversely affect the element when the heater structure is subjected to externally applied forces which flex and bend the heater structure.

It is an object and feature of this invention to provide a heater structure of the general character referred to above wherein the reinforcing strate comprises a thin, flat, flexible sheet of substantially non-ductile resilient material such as spring metal, resilient plastic resin sheeting, fiberglass reinforced resin sheeting and the like.

Another object and feature of the invention is to provide a heater of the character referred to wherein the resilient reinforcing strate is adjacent and in secure stationary relationship to the surface of the carrier sheet opposite the surface of the sheet with which the element is related, whereby the strate and element are electrically insulated from each other by the sheet and so that the sheet is dimensionally stably supported by the strate.

Yet another object and feature of the invention is to provide a heater structure of the character referred to wherein the carrier sheet, strate and element assembly is within a hermetically sealed envelope of thin, flexible, electric insulative, plastic sheet material.

It is an object and feature of the present invention to provide a heater structure of the character referred to above wherein the adjacent opposing surfaces of the envelope, strate, carrier sheet and element are secured together by electrically non-conductive means, whereby the several laminates establish an integrated structure wherein the several laminates are supported by each other and each lends dimensional stability to each other.

It is an object and feature of the invention to provide the heater structure of the general character referred to above wherein the reinforcing strate is a heat conductive heat distributing metal part which serves to conduct and distribute heat generated in the structure substantially uniformly throughout the effective heating plane of the structure.

Another object of the invention is to provide a heater of the character referred to including novel temperature sensing and/or control means to sense the temperature of the heater and to control the supply of current to the element.

It is an object of the present invention to provide a structure of the character referred to above including an elongate, flexible power supply cord and coupling means coupling the conductors of the cord with terminals on the element and connecting means connecting the control means in and with the conductors; said coupling and connecting means are arranged and positioned within a limited predetermined area within the surface area of the heater structure and are retained and protected within a body of insulative potting material on the heater whereby the greater bulk and mass afforded by said means and the potting material is concentrated within a limited predetermined area of the heater structure.

It is an object of this invention to provide a heater of the character referred to wherein the heating element does not occupy and is spaced from the area of greater mass established by and about the coupling and connecting means.

It is an object and feature of the present invention to provide temperature sensing and control means including one or more temperature sensing devices arranged adjacent portions of the heater directly related to the element of the heater and remote from the area of greater mass and a structure including heat barrier means in the metal strate between the area of greater mass and the temperature sensing devices whereby the devices are substantially thermally isolated and their operation is not notably adversely affected by heat flowing to and from the area of greater mass.

An object of the invention is to provide a structure of the character referred to wherein the heat barrier means includes elongate slot-like through openings in the metal strate at the perimeter of the area of greater mass.

The foregoing and other objects and features of our invention will be fully understood from the following detailed description of a typical preferred form and embodiment of the invention, throughout which description reference is made to the accompanying drawings.

DETAILED DESCRIPTION OF THE INVENTION

Figures 1, 2, 3:
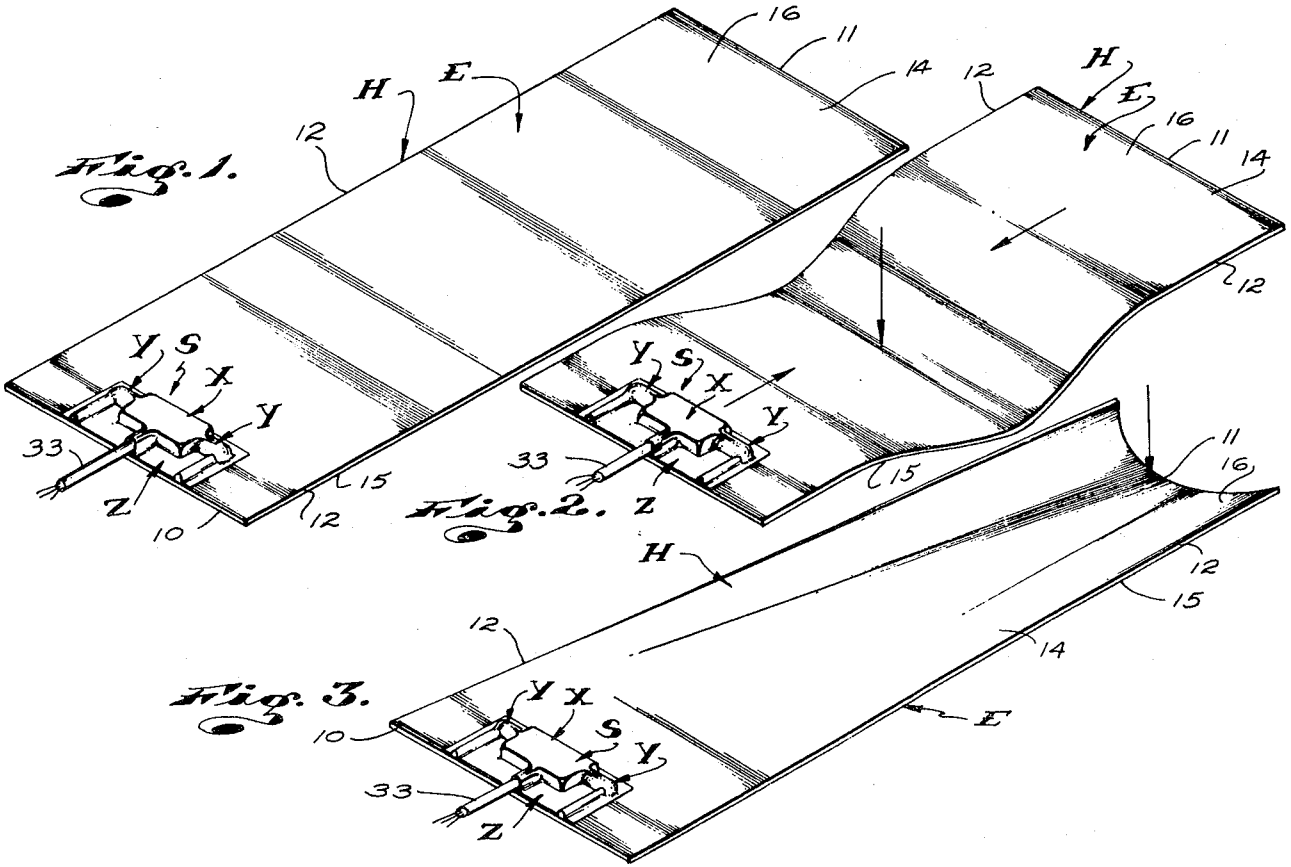
FIG. 1 is an isometric view of a heater embodying the invention.
FIG. 2 is a view similar to FIG. 1 showing the heater flexed in one direction.
FIG. 3 is a view similar to FIG. 1 showing the heater flexed in another direction.

In FIGS. 1, 2 and 3 of the drawings, the heater H embodying the present invention is shown in three different conditions or positions.

In FIG. 1 of the drawings, the heater H is shown in its normal flat condition. In FIG. 2 of the drawings, the heater is shown flexed and bent laterally, intermediate its opposite end portions by downwardly applied forces which are resolved longitudinally in and throughout the heater.

In FIG. 3 of the drawings, the heater H is shown as having one end portion bent and/or flexed on an axis angularly related to the longitudinal axis of the heater, by forces directed downwardly onto said one end portion thereof.

The heater H is an elongate, thin, flat, horizontal unit, rectangular in plan configuration. It is characterized by straight parallel front and rear ends 10 and 11, parallel side edges 12 and top and bottom surfaces 14 and 15.

Figures 4, 5, 6, 7:
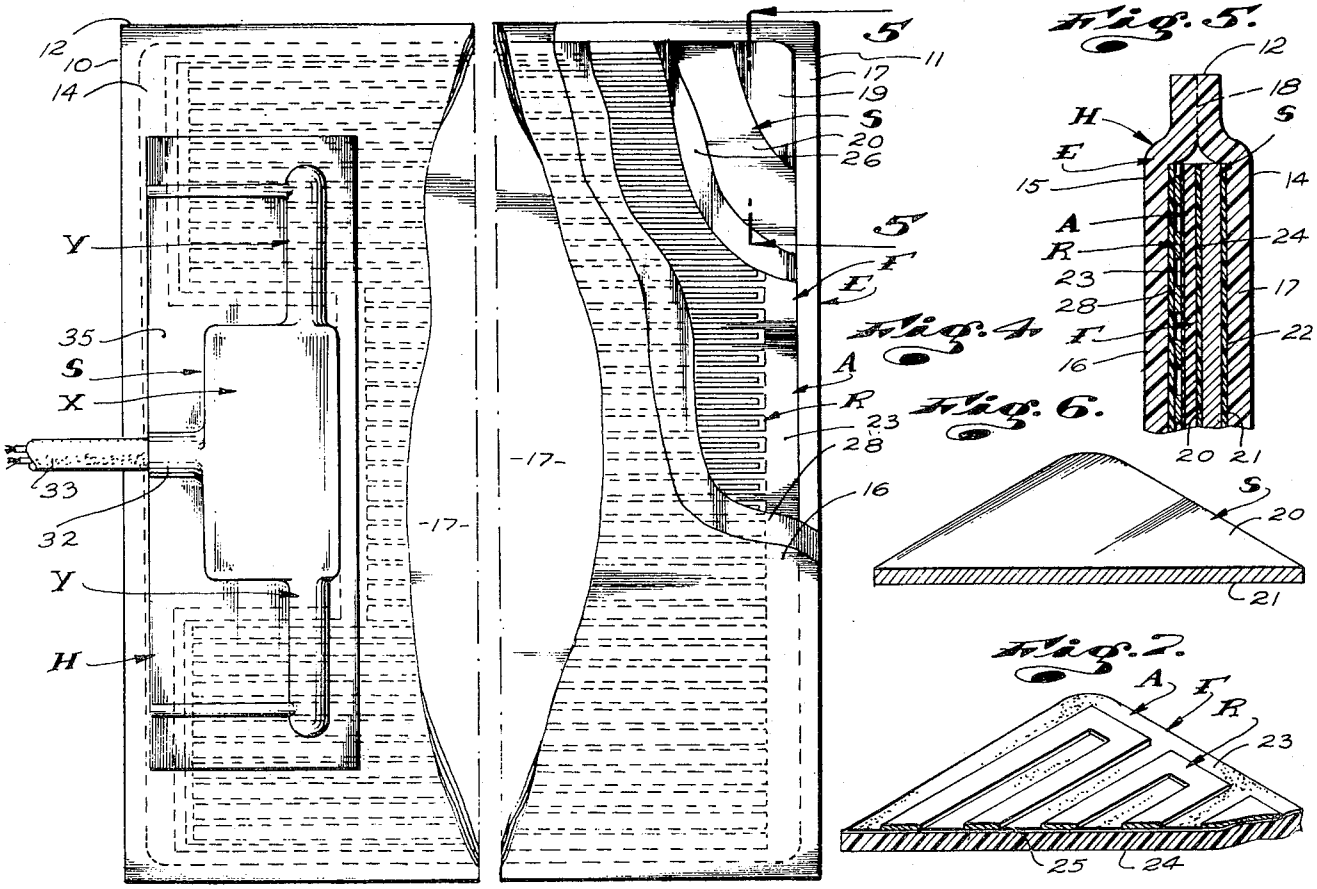
FIG. 4 is a plan view of the heater with portions broken away to better illustrate details of the construction.
FIG. 5 is an enlarged detailed view of a portion of the structure shown in FIG. 4 with portions broken away to better illustrate details of the construction.
FIG. 6 is an isometric view of a portion of the support strate.
FIG. 7 is an isometric view of a portion of the film and element sub-assembly.

The top and bottom surfaces 14 and 15 and the several edges 10, 11 and 12 are defined by a hermetically sealed envelope E of thin, flexible and pliable plastic sheeting, such as polyvinyl chloride sheeting. In the preferred carrying out of the invention, the envelope E is established of top and bottom plastic layers of sheets 16 and 17, the outside edge portions of which are welded together as indicated at 18 in FIG. 5 of the drawings. The weld 18 is a continuous weld about the perimeter of the envelope. The welded together edge portions define the noted ends 10 and 11 and the sides 12 of the envelope E.

In practice, the layers 16 and 17 can be established of a plastic sheeting which is about ten mm. thick.

Within the envelope E is a thin, flat, horizontal reinforcing plate or strate S of substantially dimensionally stable plastic material or spring metal, such as fiberglass reinforced resin or spring steel, brass or aluminum. In practice, 1/32" thick sheet metal stock has been satisfactorily used to establish the strate S. The strate S has flat top and bottom surfaces 20 and 21 and is coextensive with the interior plan configuration of the envelope E. The strate is arranged within the envelope with its bottom surface 21 in flat bearing engagement with the top surface of the bottom layer 17 of the envelope.

The strate S is held captive within the envelope E and is not free to move or become displaced therein. In the preferred carrying out of the invention, the layer 17 and reinforcing strate S are bonded or otherwise fastened together to assure against relative movement and displacement. In practice, we fasten the parts together by means of a suitable flexible cement as indicated at 22. Should the carrier sheet be established of a material, such as Teflon, with which a cement cannot effectively bond, a few strategically located metal fasteners can be effectively used to attain desired fastening of the parts together.

The heater next includes a heater sub-assembly A which includes a thin, flat, horizontal carrier sheet F of a suitable dielectric plastic, such as Mylar. The carrier sheet F has flat top and bottom surfaces 23 and 24. In practice, the sheet F need only be about two mm. thick. The sub-assembly A next includes an elongate electric resistance heater element R fixed to the top surface 23 of and carried by the film F. The element R in the heater that we produce is a thin, flat horizontal metal foil ribbon-like element which is of uniform thickness and lateral extent throughout most of its longitudinal extent and is arranged in a serpentine or zig-zag manner throughout the major part of the plan of the sheet F.

The element R is so thin and fragile that it is not sufficiently strong and self-supporting that moved about and manually manipulated without the likelihood of damage and is therefore secured to and carried by the sheet F. for necessary support.

In our reduction to practice of our invention, the element R is established by cementing a thin metal foil, such as one mm. thick aluminum foil onto the top surface 23 of the carrier sheet F by means of a suitable flexible cement 25. Thereafter, the portions of foil which are to establish the element R are masked off by a suitable masking paint or the like, applied to the top surface of the foil by printing, silk-screening or the like. Subsequently, the assembled film and painted or masked off foil is subjected to an etching bath which effects removal of the undesired foil stock and which leaves the element R on the carrier sheet.

The sub-assembly A is coextensive with the strate S and is arranged atop the strate S with the top and bottom surfaces 20 and 24 of the strate and the carrier sheet in flat opposing relationship. Though the carrier sheet F, like the strate S, is held captive within the envelope E, it is preferred that the strate and carrier sheet be fastened together to guard against relative movement or displacement. Such fastening together of the strate and carrier sheet can be effected by means of a suitable flexible cement deposited between the parts as indicated at 26. The cement can be applied in spots or can be applied throughout the opposing surfaces of the related parts.

The top layer 16 of the envelope E overlies the sub-assembly A and is preferably fastened thereto to prevent displacement of the parts. Such fastening of these parts can most conveniently be effected by a suitable flexible cement, as indicated at 28 in FIGS. 4 and 5 of the drawings.

With the above combination and relationship of parts, it will be apparent that the thin, fragile element R is captively held within the construction, between the carrier sheet F and the top layer 17, in secure and stable supported condition and that the strate S, while permitting bending and flexing of the construction, imparts dimensional stability into the construction which prevents it from being stretched or otherwise dimensionally distorted and/or worked in a manner which is likely to result in the element R being torn, broken, stretched or otherwise adversely worked upon.

With the heater construction thus far described, it will be apparent that the construction can be easily bent and/or flexed in the manners illustrated in FIGS. 2 and 3 of the drawings or in various other manners without adverse effects.

In furtherance of the invention and to facilitate connecting the element R with related power supply conductors C, the element R is formed or arranged so that an area or zone Z, within the plane of the assembly, through which the element R does not extend, is established. The element R is provided with (opposite) end portions which enter or extend a limited distance into the zone Z to join with (enlarged) terminals T. In the embodiment of our invention shown and described, the terminals T are formed integrally with the element R, on the film F, in the same manner and at the same time that the element R is formed or established.

Figures 8, 9, 10:
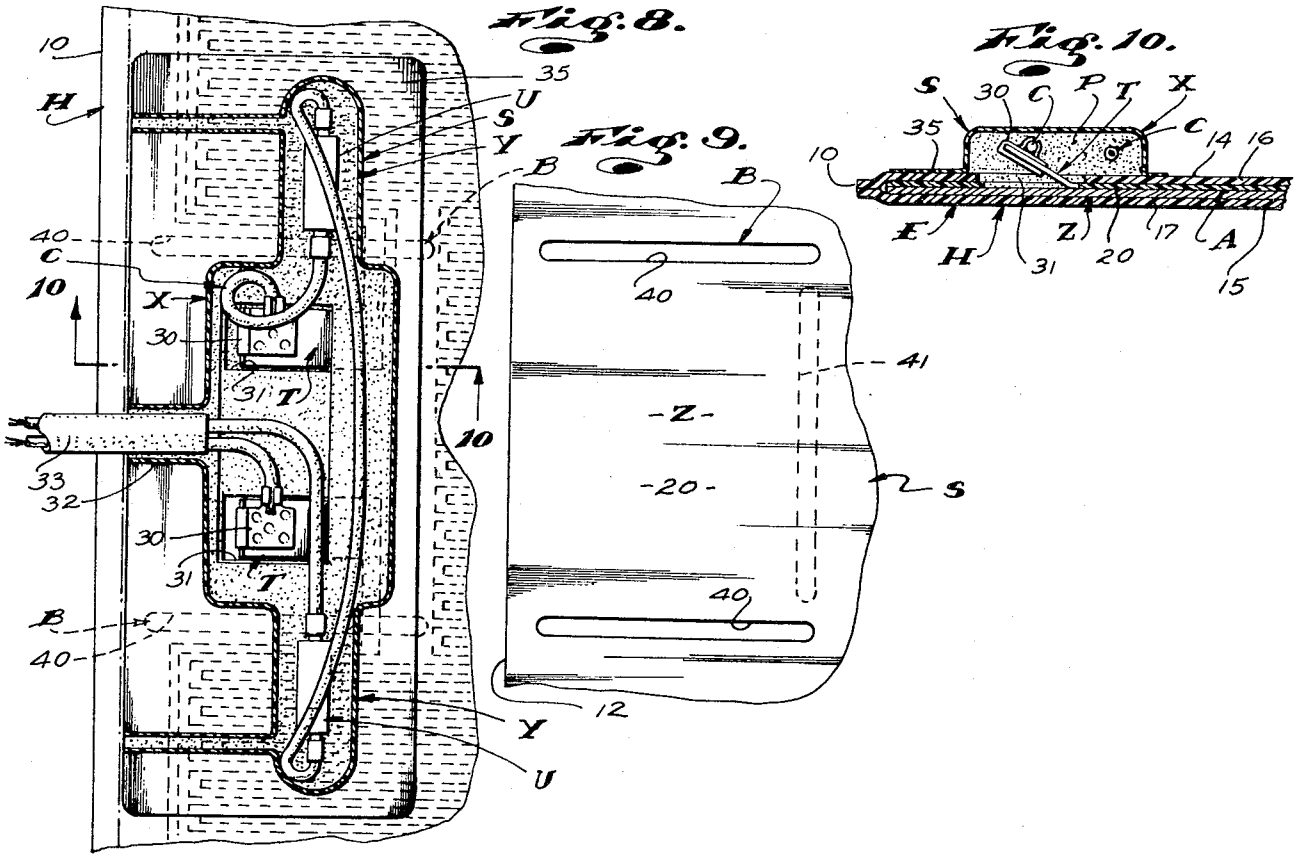
FIG. 8 is an enlarged detailed view of a portion of the structure shown in FIG. 4.
FIG. 9 is a view of another portion of the support strate.
FIG. 10 is a sectional view taken substantially as indicated by line 10—10 on FIG. 8.

The terminals T are elongate parts at the ends of the element R, within the zone Z. The carrier sheet F is preferably pierced or slit on three sides of the terminals to establish flexible terminal carrier tabs, also identified by the reference characters T. The terminal and tabs, hereinafter called "the terminal tabs T", are bent or flexed upwardly from the plane of the film to fcilitate engaging clamp-type connectors 30 therewith, which connectors are fixed to or coupled with the ends of the conductors C, as shown in FIGS. 8 and 10 of the drawings.

In furtherance of the invention, the upper or top layer 16 of the envelope E, at the zone Z of the construction, can be provided with one or a pair of spaced windows 31 through which the upwardly turned tabs T freely project.

With the above relationship of parts, it will be apparent that the conductors C, tabs T and the connectors 30 occur at and above the top plane of the envelope E, within the zone Z.

The zone Z occurs adjacent the front edge 10 about midway between the ends thereof. The zone Z is of limited planar extent and need only be large enough to accommodate the parts and/or portions of the construction noted above.

In addition to the foregoing, the invention includes temperature control means M, responsive to the temperature of the heater and operable to control the flow of current through the element R. The means M includes temperature responsive switching devices which, in the form of the invention illustrated, are normally closed cartridge type thermostatic switching units U; there being one unit U connected in each conductor C. The units U are arranged in direct heat conducting contact with the top surface of the top layer 16 of the envelope E, outside the zone Z, where the element R occurs.

The switching devices are normally closed thermostatic switch units which are operable to open when the temperature of the heater rises to predetermined temperatures. One unit U is preferably such that it opens when the desired operating temperature of the construction is reached and the other unit is a backup unit set to open at a slightly higher temperature than said one unit and is provided so that in the event said one unit fails to operate or open when desired, the other unit will open.

In practice, the second or other of said units U can be eliminated without departing from the spirit of the invention, but is preferably included to meet with those various safety codes which heaters of the character here concerned with are commonly required to meet.

In furtherance of the present invention, to provide a safe construction and to meet code requirements, the units U, conductors C, tabs T and connectors 30, at the top of the envelope E, are within and protected from the outside environment by a molded body of dielectric plastic material. In the case illustrated, the body of plastic is within a plastic shell O. The shell O is a thin-walled shell of plastic material engaged over the parts and/or components to be protected and is filled with a mass or body flexible dielectric potting material P (shown in FIGS. 10 and 11 of the drawings). The potting material P encases the various elements and parts within the shell to hold and maintain those parts and elements in desired relationship and to protect them against damage by external means and/or forces.

The shell O has an outwardly or forwardly projecting neck 32 in which the rear end portion of an elongate flexible service cable 33, from which the conductors C extend, is fixedly engaged.

In practice, the shell O has a flat rectangular mounting flange about is perimeter which establishes flat engagement on and is bonded to the top surface of the top layer 16 of the envelope E, substantially as shown.

The shell O has a large central portion X at the zone Z of the heater structure, defining a chamber in which the tabs T, connectors 30 and the major portions of the conductors C are arranged and which is filled by the potting material P. The shell also has small laterally extending wing-like branches Y extending outwardly from the zone Z over those heated portions of the construction with which the element R is related and in which the units U and short or limited portions of the conductors C are arranged and in which small volumes of the potting material P are deposited. It will be apparent that after the potting material is set, the shell O can be removed and disposed of without adverse effects.

When the strate S of the construction is made of metal, it is an extremely effective and efficient heat conductor and serves to effect rapid uniform distribution of heat throughout the plane of the heater. More particularly, the strate S conducts heat to and from the zone Z of the construction at a rapid rate.

The larger and massive central portion X of the potting material filled shell O, in which the tabs T, conductors C and connectors 30 are arranged, is an effective heat sink which absorbs and stores substantial quantities of heat conducted by the strate S at a rapid rate. The quantity of heat absorbed by the central portion X of the construction and the rate at which that heat is conducted to the portion X by the strate S is such that the portions of the heater adjacent the zone Z and with which the units U are related, are robbed of heat at such a rate that the temperature of those portions of the heater rise at a materially slower rate than the remainder of the heater. As a result of the above, the temperature of the heater construction, remote from the zone Z and the units U, can reach self-destructive limits before the portions of the heater related to the units U reach the operating temperatures of the units U.

To prevent the above noted adverse effects, the construction includes heat barrier means B about the zone Z to prevent the rapid conducting of heat through the strate S, between the zone Z and remainder of the heater construction, particularly between the zone Z and those portions of the heater construction with which the units U are related.

The heat barrier means B includes elongate slot-like openings 40 in the strate S at the perimeter of or along those sides of the zone Z adjacent which the units U occur. The openings 40 establish heat-gaps in the strate S, across which heat cannot be directly conducted by the material of the strate S.

In addition to the above noted openings 40, another opening 40' shown in the dotted lines in FIG. 9 of the drawings can be provided along the other side of the zone Z, remote from the edge 10 of the strate S.

With the heat barrier means B, here provided, the strate S is substantially ineffective to conduct heat from the areas of the heater with which the units U are related to the greater mass of the construction at the zone Z. Accordingly, the temperature of the areas of the heater with which the units U are related rapidly rise and fall in substantial direct relationship to the rise and fall of the temperature throughout the portions of the heater with which the element R is related and the temperature of the zone Z of the heater is free to fluctuate or change independent of the remainder of the construction.

In operation, should the heater be energized when there is no structure related to it to absorb and carry off the heat generated by it, the portions of the heater with which the units U are related heat at substantially the same rate as the remainder of the portions of the heater about which the element R extends and the units U open to shut off the flow of current through the element R when set operating or maximum temperatures are reached. The temperature of the zone Z during such operation does not materially alter or affect the above noted operation of the units U.

Under the same operating conditions, if the heat barrier means B was not provided, heat generated within the portions of the construction with which the units U are related would be conducted away from those portions of the construction by the strate S to the zone Z and into the greater mass of that zone, at a rate which would prevent the units U from being subjected to operating temperatures prior to that time when the portions of the heater structure remote from the zone Z and the units U reach self-destructing temperatures.

In addition to establishing heat barriers, the slots or openings 40 and 40' in the strate S impart greater flexibility to the strate about the zone A and allow for free flexing of the construction about the heavier, more massive and substantially inflexible zone Z.

In practice, when the strate S is established of a plastic material or the like, having a low index of heat conductivity, the openings 40 still serve the above noted functions, though their heat barrier function is less critical.

Having described only one typical preferred form and embodiment of the invention, we do not wish to be limited to the specific details herein set forth, but wish to reserve to ourselves any modifications and/or variations that may appear to those skilled in the art and which fall within the scope of the following claims.

Having described our invention, we claim:

1. A flat, normally horizontal, flexible blanket type heater structure comprising a thin, horizontal reinforcing strate of flexible and resilient dimensionally stable material having flat top and bottom surfaces and outside edges, a thin, flat carrier sheet of flexible dielectric material of limited dimensional stability having flat top and bottom surfaces and outside edges positioned with its bottom surface in flat opposing engagement with the top surface of the strate, an elongate, metallic electric resistance element on and arranged to extend throughout the major portion of the top surface of the carrier sheet with each portion thereof in spaced relationship from other portions thereof, said element has end portions extending to a portion of the carrier sheet spaced from the element and joined with electric terminals carried by the carrier sheet, a flat, horizontal envelope of flexible dielectric sheet material of limited dimensional stability with top and bottom layers and outside edges engaged with and about the strate, carrier sheet and element and normally holding the strate, carrier sheet and element and normally holding the strate and carrier sheet in surface to surface engagement and against movement relative to each other and having an access opening through which the terminals extend.

2. The heater structure set forth in claim 1 which further includes means fastening the sheet to the strate.

3. The heater structure set forth in claim 1 which further includes means fastening the bottom layer to the strate.

4. The heater structure set forth in claim 1 which further includes means fastening said top layer to the carrier sheet.

5. The heater structure set forth in claim 1 which further includes means fastening the top and bottom layers to the strate and to the carrier sheet.

6. The heater structure set forth in claim 1 which further includes means fastening the bottom layer to the strate and the strate to the carrier sheet.

7. The heater structure set forth in claim 1 which further includes means fastening the top layer to the carrier sheet and the carrier sheet to the strate.

8. The heater structure set forth in claim 1 which further includes means fastening the top layer to the carrier sheet, the carrier sheet to the strate, and the strate to the bottom layer.

9. The heater structure set forth in each of claims 2, 3, 4, 5, 6, 7 or 8 wherein the fastening means is a flexible cement deposited between the fastened together parts.

10. The heater structure set forth in claim 1 wherein said access opening is in said top layers, said terminals project up through said opening and which structure further includes an elongate power supply cable with one end portion adjacent said top layer and which has conductors connected with said terminals; and a primary body of dielectric material formed about said end portion of the cable, conductors and terminals and bonded to the top layer about said opening.

11. The heater structure set forth in claim 10 which further includes at least one temperature responsive switching device series connected in the circuit established by the element and the conductors arranged in heat conducting contact with a portion of said top layer overlying portions of said element and operating to open the circuit when the temperature of the portion of a heater adjacent the device reaches a predetermined temperature.

12. The heater structure set forth in claim 11 wherein said device is positioned remote from said primary body of material and within a secondary body of dielectric material bonded to said top layer and of less volume and mass than the primary body.

13. The heater structure set forth in claim 12 wherein said secondary body of dielectric material is joined with and projects from said primary body of dielectric material.

14. The heater structure set forth in claim 11 wherein the strate is made of material having a high index of heat conductivity and wherein the volume and mass of the primary body of dielectric material and the terminals, cables and conductors therein establish a heat sink and storage portion of major mass in the heater structure which is spaced from the element and the temperature responsive device, said strate has a heat gap therein positioned between said device and said portion of major mass whereby the temperature of the portion of the heater structure where said device is positioned is substantially unaltered by heat conducted to it from the portion of major mass by said strate.

15. The heater structure set forth in claim 14 wherein said device is positioned remote from said primary body of material and within a secondary body of dielectric material bonded to said top layer and of less volume and mass than the primary body.

16. The heater structure set forth in claim 15 wherein said secondary body of dielectric material is joined with and projects from said primary body of dielectric material.

17. A multi-laminate heater structure with a heat conducting and distributing reinforcing strate, an elongate, electric resistance element electrically insulated from and extending about a surface of a major portion of the strate, said element has end portions joined with terminals in the heater structure adjacent a minor portion of the strate adjacent said major portion thereof and spaced from the element, an elongate power cable extending to the heater structure with one end portion terminating adjacent said minor portion of the strate and having conductors connected with the terminals, a body of heat absorbing dielectric material about said end portion of the cable, the terminals and the conductors and in heat transfer relationship with aid minor portion of the strate, at least one temperature responsive switching device in heat conducting relationship with the heater structure related to the major portion and adjacent a side of the minor portion of the strate and series connected in the circuit established by the element and conductors and operating to open the circuit when the temperature of the portion of the heater structure with which it is related reaches a predetermined elevated temperature, said strate has a heat gap opening in it between its major and minor portions stopping conduction of heat by the strate between the portions of the heater structure at opposite sides of the heat gap opening.

18. The heater structure set forth in claim 17 wherein said strate and said element are within an envelope comprising top and bottom layers of dielectric material with outer edges joined about the perimeter of said strate.

19. The heater structure set forth in claim 18 which further includes a carrier sheet of dielectric material between the strate and the element and which carries said element.

20. The heater structure set forth in claim 17 which includes a carrier sheet of dielectric material between the strate and the element and which carries the element.

* * * * *